US005152934A

United States Patent [19]

Lally et al.

[11] Patent Number: 5,152,934

[45] Date of Patent: Oct. 6, 1992

[54] MIXING SYSTEM FOR GAS DISPERSION IN LIQUIDS OR LIQUID SUSPENSIONS

[75] Inventors: Kenneth S. Lally, Honeoye Falls; Richard A. Howk, Rochester, both of N.Y.

[73] Assignee: General Signal Corp., Stamford, Conn.

[21] Appl. No.: 682,508

[22] Filed: Apr. 8, 1991

[51] Int. Cl.[5] ..... B01F 3/04; B01F 7/22

[52] U.S. Cl. ..... 261/93

[58] Field of Search ..... 261/93

[56] References Cited

U.S. PATENT DOCUMENTS

| | | | |
|---|---|---|---|
| 3,342,331 | 9/1967 | Maxwell | 261/93 |
| 3,420,370 | 1/1969 | Isenhardt et al. | 261/93 |
| 3,643,403 | 2/1972 | Speece | 261/93 |
| 3,731,522 | 5/1973 | Mikesell | 261/93 |
| 4,454,078 | 6/1984 | Engelbrecht | 261/93 |
| 4,882,098 | 11/1989 | Weetman | 261/93 |

OTHER PUBLICATIONS

Ch. Breucker, A. Steiff & P. M. Weinspach, Proceedings of the Sixth European Conference on Mixing, Pavia, Italy, 24-26, May 1988, p. 399.

*Primary Examiner*—Tim Miles

*Attorney, Agent, or Firm*—Martin Lukacher

[57] ABSTRACT

In order to obtain efficient gas dispersion (aeration where air is the gas) in mixing systems where the circulating impeller is offset from the center of the tank containing the medium in which the gas is dispersed or sparged while being circulated, flooding of the impeller due to entrainment of gas released by the sparging device (a pipe or ring having as outlets) because of the asymmetrical return flow of the medium circulating in the tank which entrains the gas and brings the gas into the area swept by the impeller as it rotates, is avoided by arranging the sparging device to prohibit the release of gas into a region, including a sector of the swept area, where the return flow responsible for flooding occurs. This sector has been found to lie along a line between the center of the tank and the axis of rotation of the impeller. The gas dispersion mixing system is especially useful in dispersion of gas into large volumes (e.g. 20,000 cubic feet). There, a plurality of axial flow impellers and associated sparging devices are circumferentially spaced around the center of the tank. The sparging devices are arranged so that gas is prohibited from being released in the region where the gas is subject to being entrained into the impellers swept area by the asymmetrical return flow, thereby avoiding flooding and increasing gas dispersion (mass conversion) in the mixing system.

4 Claims, 7 Drawing Sheets

MIXING SYSTEM FOR GAS DISPERSION IN LIQUIDS OR LIQUID SUSPENSIONS

The present invention relates to mass conversion mixing systems and particularly to mixing systems which disperse or sparge gas into a liquid medium which may have solids in suspension.

The invention is especially suitable for use for gas dispersion into an extremely large volume of a liquid in which solids are maintained in suspension, as where it is desired that reactions between the suspended solids and/or the suspending liquid and the gas be promoted. The invention enables efficient dispersion, while maintaining the solids suspended in the liquid medium throughout the large volume. By a large volume is meant a volume contained in a vessel or tank which is so large as to require a plurality of mixers or agitators to suspend the solids in the liquid while circulating the suspension. A typical large volume may be 20,000 cubic feet or over one million gallons.

Efficient gas dispersion is obtainable using a mixer disposed in the center of a tank; for example with the axis of rotation of the impeller and its shaft along the axis of symmetry of the tank. This axis of symmetry for a circular tank, defined by a bottom and a cylindrical wall, is the axis of the cylindrical wall. A mixing system for efficient sparging of gas having such a symmetrical or central disposition in a tank is the subject matter of U.S. Pat. No. 4,882,098 issued Nov. 21, 1989 to Ronald J. Weetman.

Where the mixer is offset from the center of the tank, as is desirable when a plurality of mixers are required for the circulation of a large volume of liquid in a large tank, efficient gas dispersion has been difficult or impossible to achieve. Also, circulation of the liquids and the ability of the impellers to suspend solids is impeded or is not obtained without driving the impellers with mechanical forces (torque) which necessitate the application of large amounts of power (the electrical power used by the drive motors of the mixers). The problem has been found to persist notwithstanding the type of impeller which is used (either a radial flow impeller, such as shown in U.S. Pat. No. 4,454,078 issued Jun. 12, 1984 to H. Engelbrecht or an axial flow impeller such as shown in the above-referenced Weetman patent). The use of baffles alone has not solved the problem even when specially arranged in the tank. For discussion of technology involving baffles in mixing type sparging systems, see an article by Ch. Breucker, A. Steiff and P.M. Weinspach which appeared in the Proceedings of the Sixth European Conference on Mixing, Pavia, Italy, 24–26 May, 1988, page 399.

The solution to the problem, which was discovered in accordance with the invention, arises out of the recognition of the existence of an asymmetrical flow pattern in the vessel having an asymmetrically disposed mixer therein, particularly for the return flow to the mixer impeller. An asymmetrically disposed mixer is a mixer which is offset from the center of the vessel, between a vertical line through the center of the vessel and the side wall of the tank as shown in FIGS. 1 and 2. In a centrally disposed (symmetrical) impeller arrangement having an axial flow impeller, in which the outlet flow is downward towards the bottom of the tank, the outlet flow bends around the bottom of the tank and then is symmetrical about the axis of rotation of the impeller. The flow continues to near the top of the tank and returns down along the axis to the low pressure or inlet slide of the impeller. In the asymmetrical case shown in FIGS. 1 and 2, the impeller 10 is disposed in a tank 12 between a vertical line 14 which may be the center line of the tank. This line is spaced at equal radial distances from the wall of the tank, and is the axis of the cylindrical wall of the tank in the case illustrated in FIGS. 1 and 2. The shaft 16 of the mixer and the impeller are disposed along the axis of rotation of the impeller. The outlet flow 18 is towards the bottom of the tank and then radially along the bottom, as illustrated by the radial arrows 18 in FIG. 2, for one impeller 10 of three asymmetrically disposed impellers 10, 20 and 22 in the tank 12. The outlet flow continues upwardly in the direction of the axis of rotation of the impeller. Instead of returning symmetrically with respect to the axis of the impeller, the return flow is asymmetric. This return flow is indicated by the arrows 24 and 24A. The flow, as shown by the arrows 24A, returns above the impeller 10 into its inlet or low pressure side in a region between the axis of rotation of the impeller and the center line 14.

The effect of this asymmetrical flow pattern of the return flow on gas which is released by conventional sparging means such as the sparge ring 26 illustrated in FIGS. 3 and 4 is to entrain the gas released in a region 28 between the vertical line 14 and the axis of rotation of the impeller 10. The entrained gas is illustrated by the bubbles 30 which are released in the region 28 as shown in FIGS. 3 and 4. These bubbles are caught in the cross current produced by the return flow which pulls enough gas into the impeller to flood the impeller. This flooding condition, which is defined and described in the above referenced Weetman patent, reduces the efficiency of gas dispersion and interferes with the liquid pumping operation of the impeller. The amount of circulation is reduced, thereby reducing the ability of the impeller to suspend solids in the liquid by circulation of the liquid.

It is the principal object of the invention to provide an improved mixing system which affords efficient mass transfer and gas dispersion of gas into a liquid wherein the impeller of the mixer is offset from the center of a tank containing the liquid, and also to maintain the pumping rate of the liquid by the impeller so as to promote and maintain solids in suspension in the liquid and mix or blend all the liquid in the tank.

It is a further object of the invention to provide an improved mixing system which may readily be installed in existing mixers having sparging means for the introduction of gas without major modifications and/or reconstruction of the mixing and gas dispersion system.

Briefly described, a system for introducing gas into a liquid or a liquid-solid suspension medium in a vessel, while circulating the medium therein, comprises means including at least one impeller which circulates the medium in the vessel. The circulation is desirably at a rate to maintain the suspension of solids in the liquid. The impeller has an axis of rotation about which it rotates to sweep a circular area about the axis. The vessel has its center defined by a vertical line extending from the bottom of the vessel in the same direction as the wall of the vessel. The impeller is disposed asymmetrically in the vessel with its axis of rotation and swept area between the vertical line and the wall. It produces a flow pattern of outlet and return flow of the medium in the vessel, which is asymmetrical with respect to the axis of rotation of the impeller and in which the flow in part returns to the impeller in a region of the swept area between the axis of rotation and the vertical line. Sparging means are provided for introducing gas into the medium and into the outlet flow from the impeller. The sparging means is arranged to prohibit the introduction of the gas into the region thereby preventing the entrainment of gas released by the sparging means into the region and the flooding of the impeller by such entrained gas.

The foregoing objects, features and advantages of the invention, as well as presently preferred embodiments thereof will become more apparent from a reading of the following description in connection with the accompanying drawings in which:

FIG. 2 is a plan view illustrating the flow in a plural impeller system wherein each impeller is asymmetrically disposed with respect to the center of the tank and showing the asymmetrical flow pattern about one of the impellers, the flow pattern about the other impellers being similar;

Figure 6:
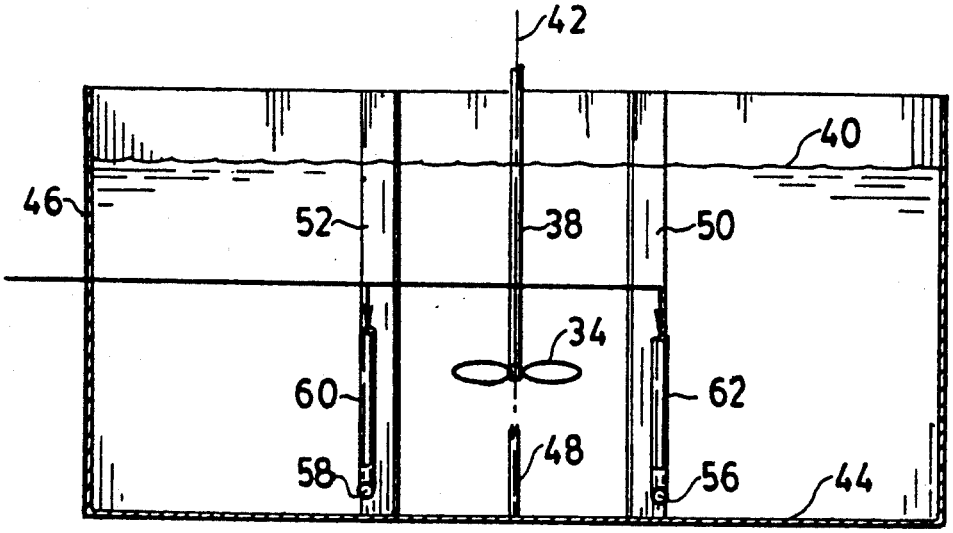
FIG. 6 is a fragmentary sectional view taken along the line 6—6 of FIG. 5.

Referring to FIGS. 5, 6, 9 and 10, there is shown a tank or vessel 30 which is illustrated as a cylindrical tank (it being appreciated that the invention may be applied to other shape tanks such as rectangular or elliptical tanks). The tank 30 contains a large volume of liquid and solids which are to be suspended in the liquid by circulation introduced by a plurality of mixers. Three mixers are shown by different impellers 32, 34 and 36, each driven by a shaft 38 via a hub. The tank may be extremely large, for example, 36 feet in diameter and 18 feet high and contain a large volume, for example, twenty thousand cubic feet of liquid; the surface 40 of which is shown in FIG. 6.

The impellers 32, 34 and 36 are of the axial flow type such as the type A-315 impellers sold by Lightnin ® (A Unit of General Signal Corporation) Rochester, New York 14611, U.S.A. Each impeller 34 has a vertical axis of rotation and the tank has a center which is defined by a vertical line 42. In the illustrated case, the vertical line is the axis of symmetry of the cylindrical tank. The line 42 extends from the bottom 44 of the tank and is symmetrical with the side wall 46 thereof. Each impeller 32, 34 and 36 is surrounded by three baffles 48, 50 and 52. These baffles are plates which are disposed 120 degrees apart. One of these baffle plates is disposed along a line 54 (see FIG. 9) between the axis of rotation of the impeller and the vertical line or central axis 42 of the tank. This line 54 is along a diameter of the tank in FIGS. 5, 6, 9 and 11 of the drawings. In other words, the sides of the baffle plate 48 are parallel to the line 54. The baffles serve to straighten the outlet flow from the impellers. The presence of the baffles does not affect the asymmetrical return flow which entrains gas released by the sparging means of the system. In the embodiments illustrated in FIGS. 5, 6, 9 and 10, these sparging means are tee shaped pipes 56 and 58 having lower sections with opposite ends open for the discharge of the gas which is to be dispersed. This gas may be air in the case of aeration systems or some other gas where reactions are required with solids suspended in the tank or the liquid medium which is circulated in the tank; for example, conversion reaction of calcium sulfite to calcium sulfate in the flue gas desulpherization process in the tank. The sparge pipes are connected to risers 60 and 62 into which the gas is delivered. These risers and conduits connected thereto constitute a sparged gas feed arrangement.

Figure 9:
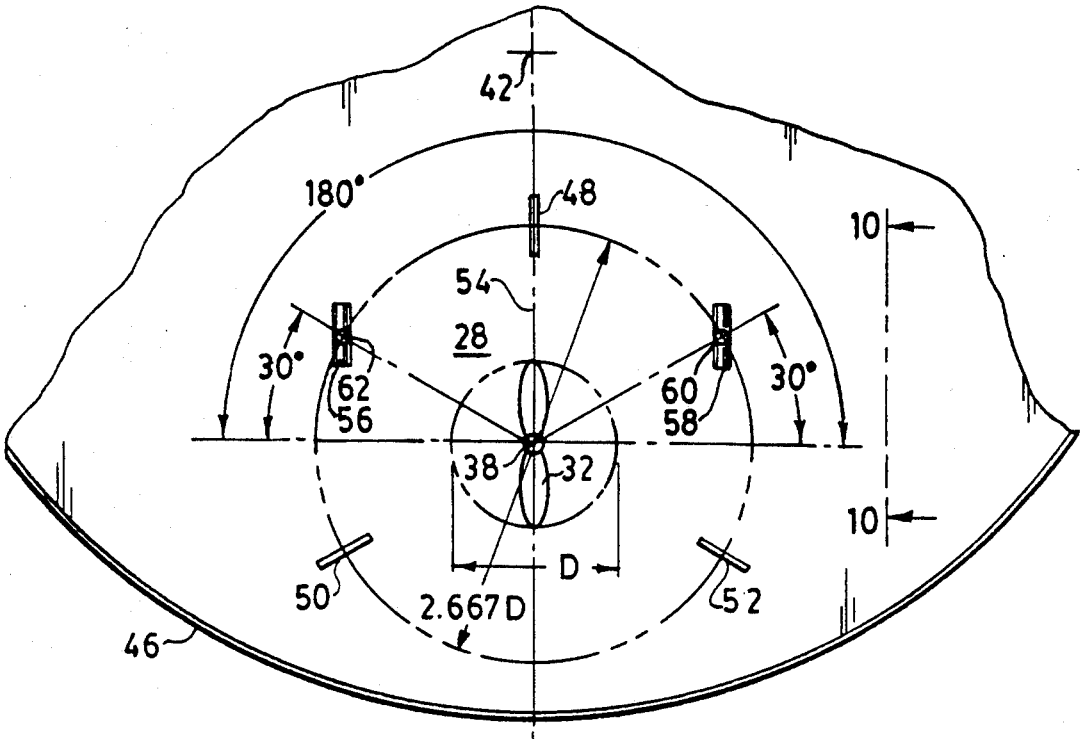
FIG. 9 is a fragmentary sectional view of a multiple impeller system illustrating the arrangement of sparging means similar to the sparging means shown in FIGS. 5 and 6 in greater detail.
Figure 10:
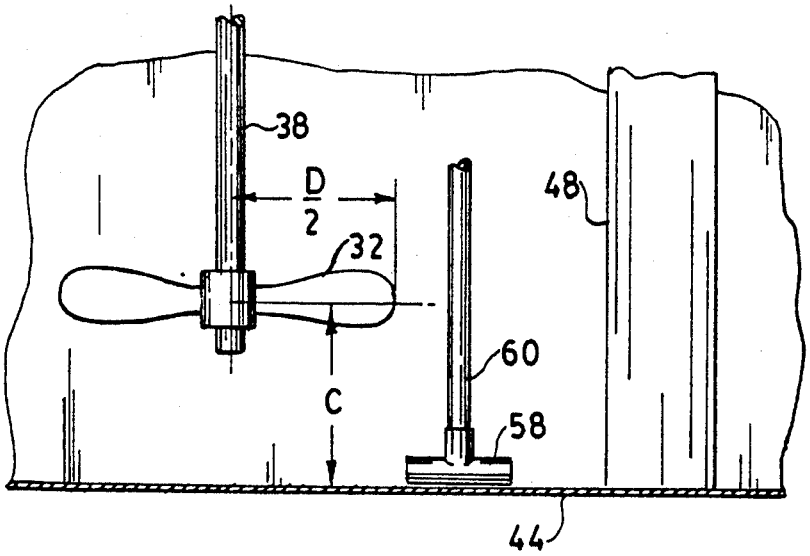
FIG. 10 is a fragmentary sectional view taken along the line 10—10 in FIG. 9.

As the impeller rotates, the impeller having a diameter D, it sweeps an area (a swept area) of diameter D which is a circular area. The asymmetrical return flow is into a section of this area as shown in FIGS. 1 through 4. The return flow, which is asymmetrical and enters the swept area on the top (lower pressure) or inlet side of the impeller 32 exists, as discovered in accordance with the invention, in a certain region 28. This region is defined by a sector of a circle centered at the axis of rotation of the impeller, for example, the impeller 32 as shown in FIG. 9. This sector decreases in included area with increasing radial distance from the axis of rotation. For example, at 1.35 D for a typical axial flow impeller, the sector includes an angle of 180 degrees. This sector is bisected by the line 54 between the vertical line 42 and the axis of rotation of the impeller. For a further out radial distance of 2.667 D, the sector decreases to 120 degrees. Beyond 2.667 D, the return flow is diminished. The region where the asymmetrical return flow entrains gas released from the sparge depends upon the diameter and speed of the impeller and the rheological characteristics (e.g. viscosity) of the medium in the tank.

The principal feature of the invention is to locate the sparge entirely outside of the region 28 where the return flow is asymmetrical and entrains the sparged gas. The region 28 is generally a section of a cylinder having an included angle of 120 degrees to 180 degrees which is bisected by the line 54.

Figure 1:
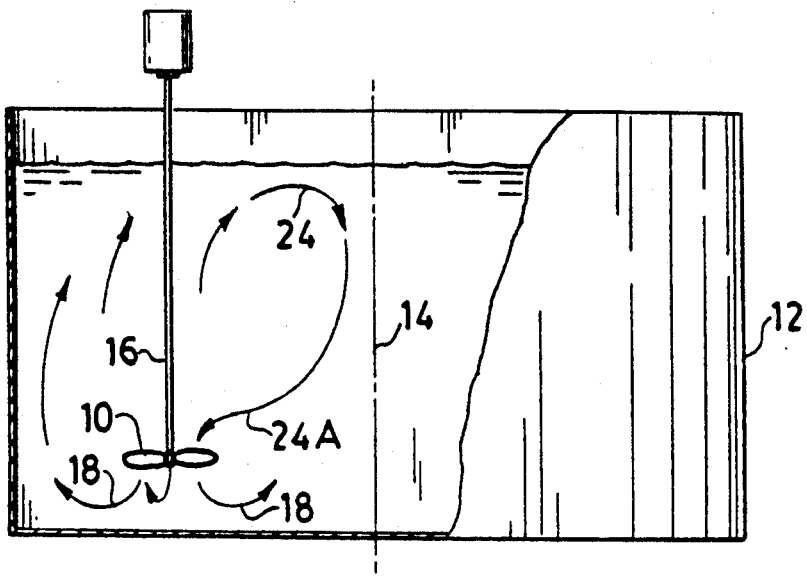
FIG. 1 is an elevational view showing the flow pattern in a tank produced by an axial flow impeller which is asymmetrically disposed with respect to the center of the tank, which flow pattern is discussed above.
Figure 2:
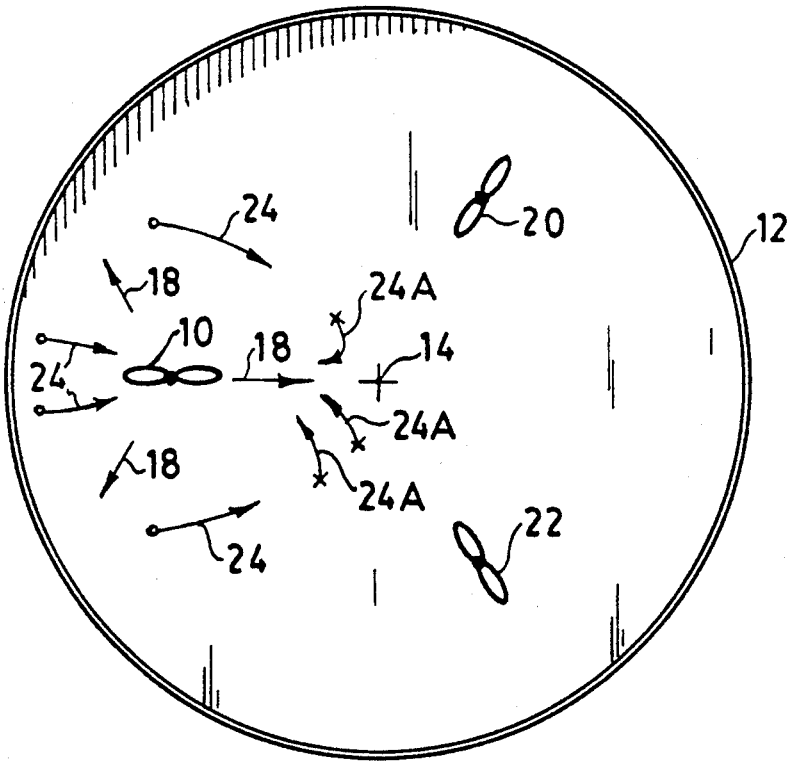
Figure 3:
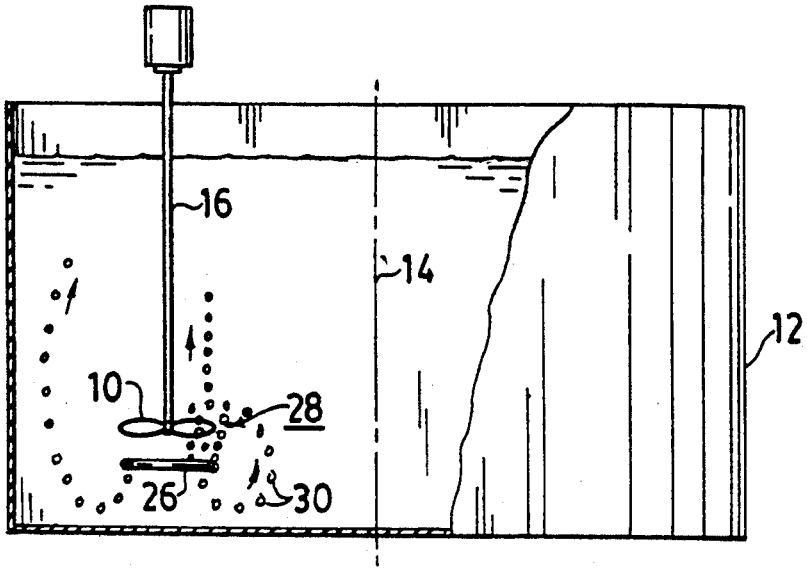
FIG. 3 is an elevational view of a mixer impeller in a tank similar to FIG. 1 and showing the release of gas by the sparge and the entrainment of gas into the impeller which causes flooding thereof.
Figure 4:
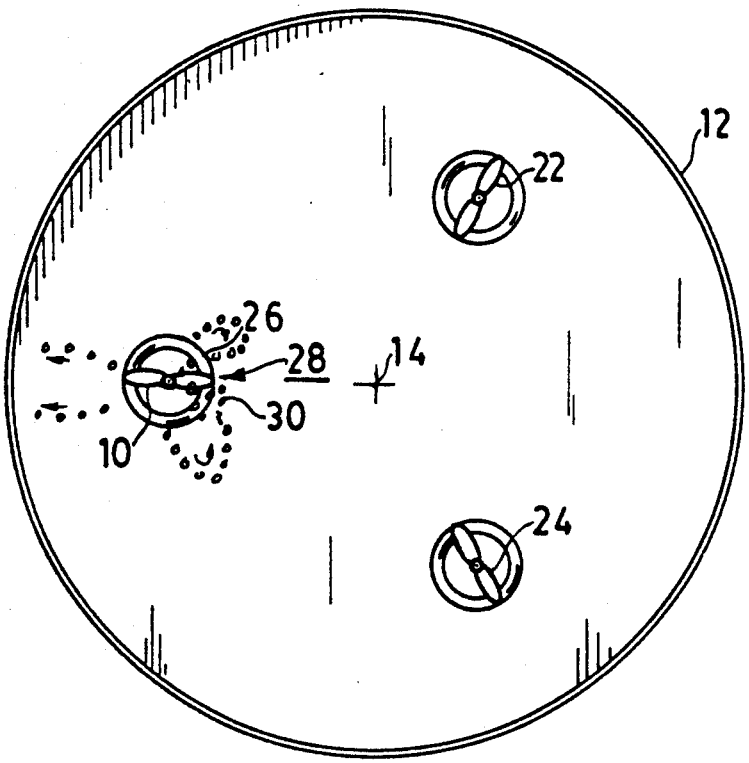
FIG. 4 is a plan view of a plural impeller system such as shown in FIG. 2 and illustrating the sparge and the effect of the flow pattern or cross currents on the gas released by the sparge.
Figure 5:
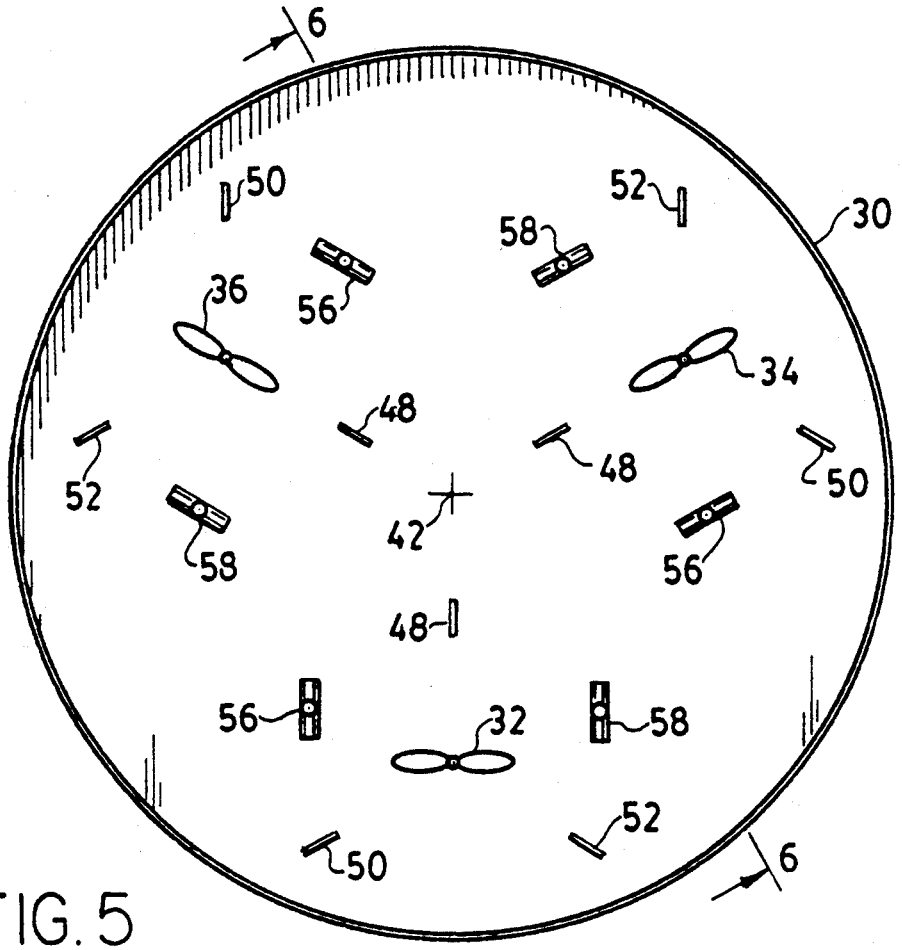
FIG. 5 is a plan view of a system for mixing and gas dispersion, using a plurality of mixers, in accordance with the invention.
Figure 7:
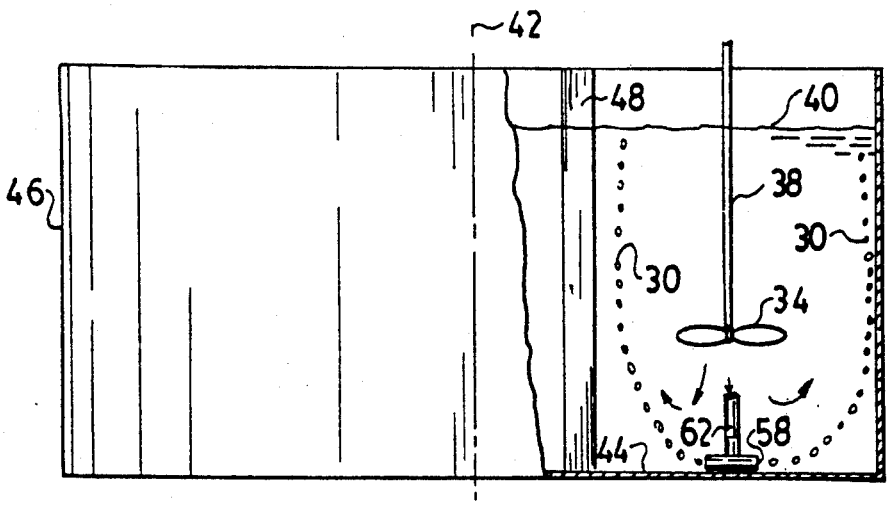
FIG. 7 is a diagrammatic elevational view showing an asymmetrical mixing and sparge system in accordance with the invention showing the release and dispersion of gas in the outlet flow from the impeller without entrainment and flooding as in the case illustrated in FIG. 3.
Figure 8:
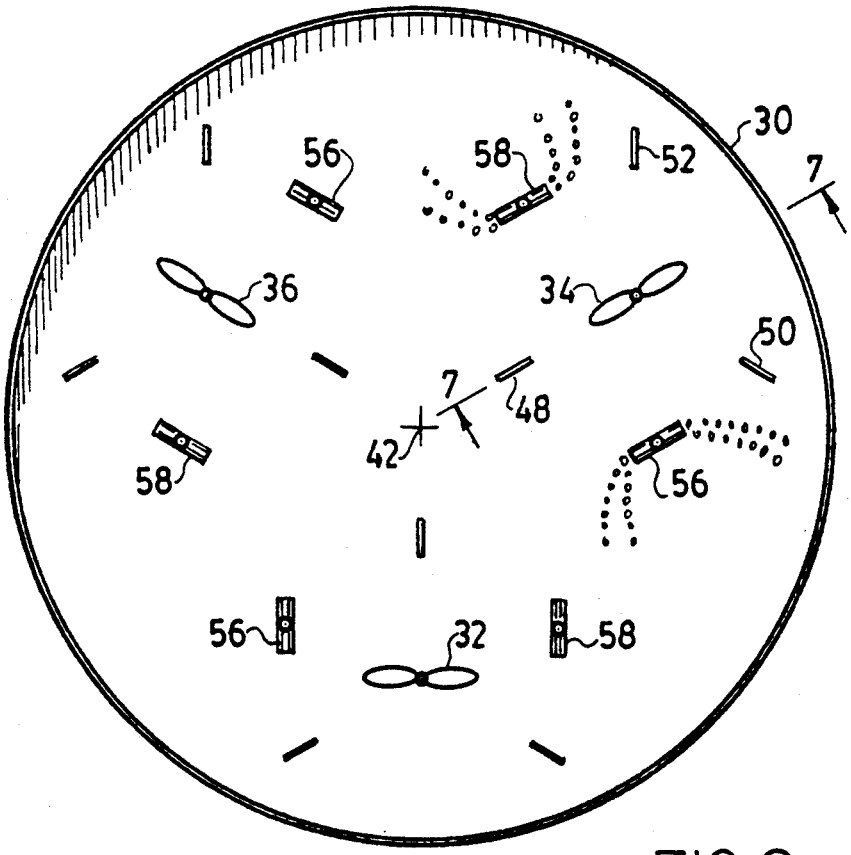
FIG. 8 is a plan view of the mixing system shown in FIG. 7.

FIGS. 7 and 8 show the results obtained and the elimination of flow which can cause flooding, as can be observed by comparison of FIGS. 7 and 8 with FIGS. 3 and 4.

Various sparge devices can be used. The tee shaped sparge device is preferably disposed with its gas release section (the bottom section at the bottom 44 of the tank and aligned parallel to the line 54), i.e. aligned with the central baffle 48.

Figure 11:
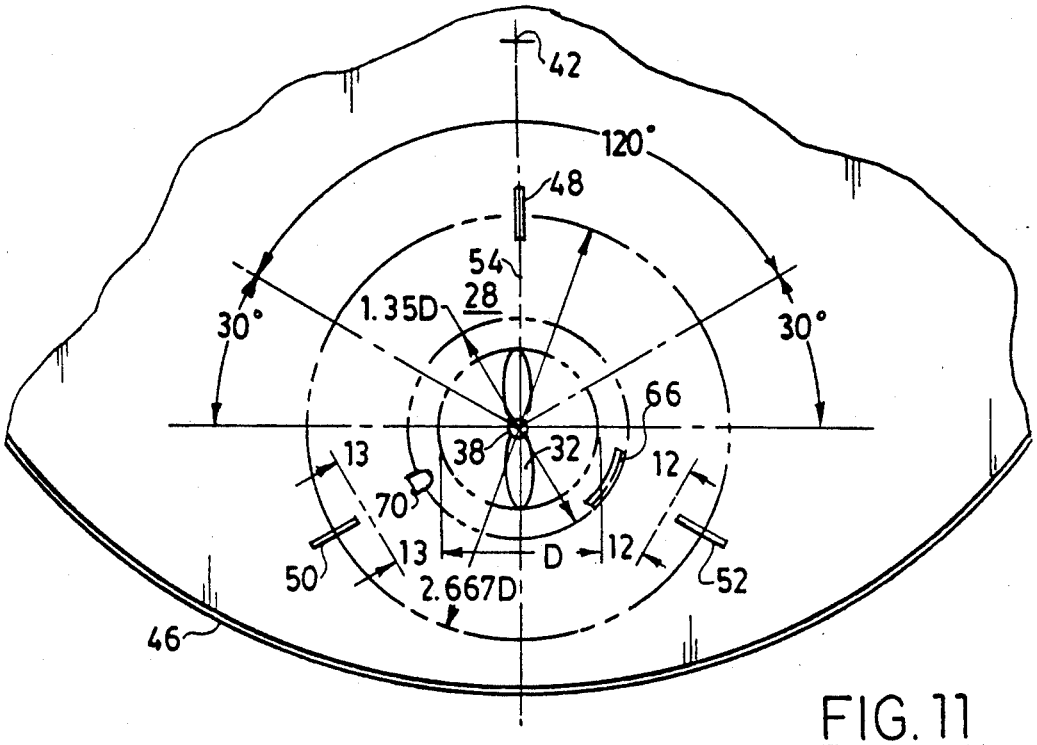
FIG. 11 is a view similar to FIG. 9 illustrating the use of an elbow type and a circular segment type sparge device, it being appreciated that while both elbow and a circular segment type sparge device are shown in FIG. 11, either two elbow type sparge devices or two circular segment type sparge devices are preferably used together to provide sparging means of the mixing system.
Figure 12:
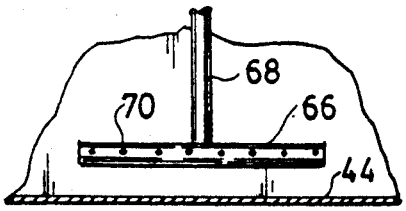
FIG. 12 is a framentary sectional view of the circular segment type sparge device, the view being taken along the line 12—12 in FIG. 11.

Other sparge devices such as a circular segment type 66 illustrated in FIGS. 11 and 12 may be used. This circular segment is connected to a riser 68. A cage around the riser may be used to support sparge 66 and another similar sparge around a circle of diameter greater than that of the swept area. The circular segment sparge 66 is shown disposed entirely outside of the prohibited region 28 where asymmetrical return flow can entrain gas to cause flooding of the mixing system. The circular segment 66 has gas discharge openings 70 facing radially outward from the axis of rotation of the impeller. The circular segment is disposed at or slightly above the bottom 44 of the tank so as to release gas in the radial outlet flow from the impeller 32. The circular segment is part of an arc of a circle of radius 1.35 D and is conveniently disposed in line with one of the baffles 52.

Figure 13:
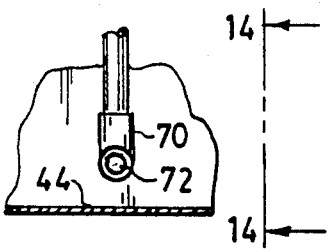
FIG. 13 is a sectional view taken along the line 13—13 in FIG. 11 of the elbow type sparge device.
Figure 14:
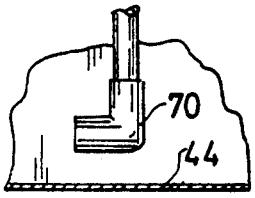
FIG. 14 is a view taken along the line 14—14 of FIG. 13.

The sparge device may be an elbow 70 which is also disposed in line with the back baffles 50 and 52 as was the case when a circular segment sparge 66 is used. The elbow has an opening 72 where gas delivered by the sparged gas feed is released. This opening faces radially outward away from the axis of rotation of the impeller so that the gas is released in the radial outlet flow at or near the bottom 44 of the tank (see FIGS. 13 and 14). While either type, tee or circular segment sparge devices are presently preferred, other types of sparge devices which deliver gas in sufficient flow rates to support the mass transfer from the gaseous to the liquid phase may be used.

Figure 15:
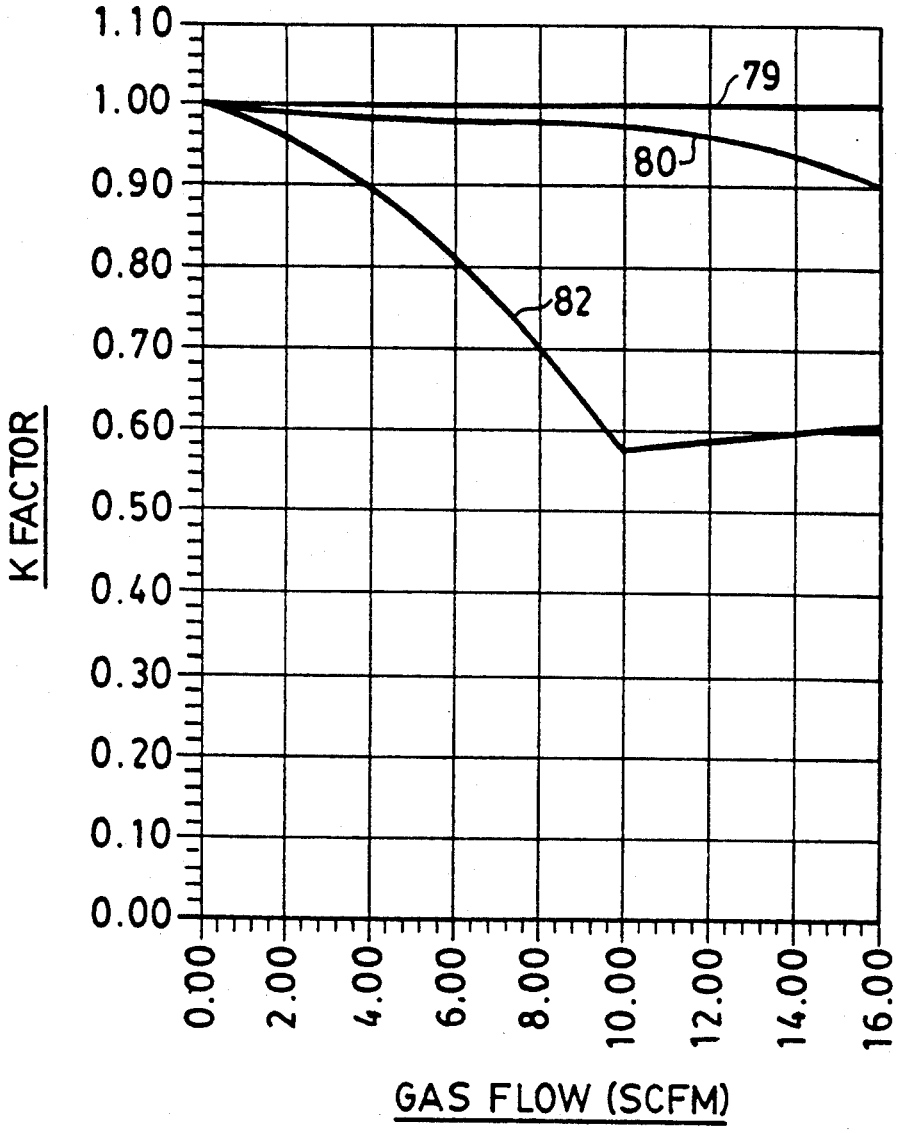
FIG. 15 is a curve illustrating the efficiency of gas dispersion in terms of K factor versus air flow versus flow rate, the definition of the flow and K factor terms being as set forth in the above referenced Weetman patent.

Referring to FIG. 15, there is shown data which shows the efficiency of mass transfer in terms of the gas flow and the resulting K factor. Curve 79 shows the case where a single impeller is symmetrically disposed in the tank; the impeller being of the type (A315) shown in the above-referened Wiltman patent. The present invention enables system performance in the case of an asymmetrical mixing system to approach that obtained in the symmetrical case. The improvement and maintenance of K factor where the invention is employed is shown in curve 80. The use of a conventional sparging means where gas is released into the prohibited region is shown in curve 82. A substantial increase in efficiency of operation and the ability to suspend solids without substantial increases in impeller driving power over the conventional approach is seen. In some cases sufficient power cannot be delivered to suspend solids in the liquid while releasing gas when the invention is not employed. Accordingly, the invention provides substantial improvements in activity and efficiency of operation of a sparged gas mixing system where the impellers are disposed in asymmetrical relationship with respect to a tank.

From the foregoing description, it will be apparent that there has been provided improved mixing systems, especially adapted for gas dispersions. This system has surprising advantages over conventional gas dispersion mixing systems where the mixer is disposed asymmetrically with respect to the tank. While various embodiments of the system and parts thereof have been illustrated, variations and modifications thereof within the scope of the invention will undoubtedly suggest themselves to those skilled in the art. Accordingly, the foregoing description should be taken as illustrative and not in a limiting sense.

We claim:

1. A system for introducing gas into a liquid or liquid-solid suspension medium in a vessel while circulating said medium therein, said vessel having a bottom and a wall extending from said bottom, said system comprising means including at least one impeller for circulating said medium in said vessel, said impeller having an axis of rotation about which it rotates to sweep a circular area about said axis, said vessel having its center defined by a vertical line extending from said bottom in the same direction as said wall, said impeller being disposed asymmetrically in said vessel with said axis of rotation and said swept area between said vertical line and said wall to produce a flow pattern of outlet and return flow of said medium in said vessel which is asymmetrical with respect to the axis of rotation of said impeller and in which flow returns to said impeller in a region of said swept area between said axis of rotation and said vertical line, sparging means for introducing gas into said medium which prohibits the introduction of said gas into said region thereby preventing the entrainment of gas released by said sparging means into said region and flooding of said impeller by such entrained gas, said impeller being an axial flow impeller producing said outlet flow in a direction axially of said axis of rotation, said sparging means having, entirely outside of said region, at least one gas outlet in said outlet flow, , and said sparging means gas outlet being provided by a plurality of tee shaped pipes each having a section with openings at opposite ends thereof, said pipes being located in the vicinity of the bottom of the vessel.

2. The system according to claim 1 wherein said sections generally parallel said line between said axis of rotation and said vertical line and are disposed at opposite ends of a sector of a circle around said swept area of diameter greater than said swept area, said sector being on opposite sides of said line between said vertical line and said axis of rotation, said sector defining said region.

3. A system for introducing gas into a liquid or liquid-solid suspension medium in a vessel while circulating said medium therein, said vessel having a bottom and a wall extending from said bottom, said system comprising means including at least one impeller for circulating said medium in said vessel, said impeller having an axis of rotation about which it rotates to sweep a circular area about said axis, said vessel having its center defined by a vertical line extending from said bottom in the same direction as said wall, said impeller being disposed asymmetrically in said vessel with said axis of rotation and said swept area between said vertical line and said wall to produce a flow pattern of outlet and return flow of said medium in said vessel which is asymmetrical with respect to the axis of rotation of said impeller and in which flow returns to said impeller in a region of said swept area between said axis of rotation and said vertical line, sparging means for introducing gas into said medium which prohibits the introduction of said gas into said region thereby preventing the entrainment of gas released by said sparging means into said region and flooding of said impeller by such entrained gas, said circulating means including a plurality of impellers each having an axis of rotation and a swept area, each of said impellers being disposed asymmetrically in said vessel and each producing a flow pattern which is asymmetrical with respect to its axis of rotation and each having a region of its swept area between said vertical line and its axis in which flow returns thereto, said sparging means including separate gas introducing means for each of said impellers which prohibit introduction of said gas in said region of the flow pattern of each of said impellers, said impellers being axial flow impellers spaced from the bottom of said vessel, said sparging means for each of said impellers respectively being disposed to release gas entirely outside of said region in the impeller's outlet flow, said sparging means gas introducing means for each of said impellers being tee shaped pipes having sections with gas outlet openings at opposite ends thereof, said sections generally parallel said line between said axis of rotation and said vertical line and are disposed at opposite ends of a sector of a circle around said swept area of diameter greater than said swept area, said sector being on opposite sides of said line between said vertical line and said axis of rotation, said sector defining said region.

4. A system for introducing gas into a liquid or liquid-solid suspension medium in a vessel while circulating said medium therein, said vessel having a bottom and a wall extending from said bottom, said system comprising means including at least one impeller for circulating said medium in said vessel, said impeller having an axis of rotation about which it rotates to sweep a circular area about said axis, said vessel having its center defined by a vertical line extending from said bottom in the same direction as said wall, said impeller being disposed asymmetrically in said vessel with said axis of rotation and said swept area between said vertical line and said wall to produce a flow pattern of outlet and return flow of said medium in said vessel which is asymmetrical with respect to the axis of rotation of said impeller and in which flow returns to said impeller in a region of said swept area between said axis of rotation and said vertical line, sparging means for introducing gas into said medium which prohibits the introduction of said gas into said region thereby preventing the entrainment of gas released by said sparging means into said region and flooding of said impeller by such entrained gas, said circulating means including a plurality of impellers each having an axis of rotation and a swept area, each of said impellers being disposed asymmetrically in said vessel and each producing a flow pattern which is asymmetrical with respect to its axis of rotation and each having a region of its swept area between said vertical line and its axis in which flow returns thereto, said sparging means including separate gas introducing means for each of said impellers which prohibit introduction of said gas in said region of the flow pattern of each of said impellers, said impellers being axial flow impellers spaced from the bottom of said vessel, said sparging means for each of said impellers respectively being disposed to release gas entirely outside of said region in the impeller's outlet flow, said sparging means gas introducing means for each of said impellers respectively including a plurality of elbows or a plurality of circular pipe segments, said elbows or pipe sections having openings for the release of gas facing radially outward with respect to said axis and spaced circumferentially from each other about said axis entirely outside of said region along a circle of diameter greater than the swept area of said impeller thereof.

* * * * *